US005862582A

United States Patent [19]

Sun

[11] Patent Number: 5,862,582

[45] Date of Patent: Jan. 26, 1999

[54] METHOD FOR MAKING HOLLOW WORKPIECES

[75] Inventor: Tyzh-Chiang Sun, Danville, Calif.

[73] Assignee: Kaiser Aluminum & Chemical Corporation, Pleasanton, Calif.

[21] Appl. No.: 553,080

[22] Filed: Nov. 3, 1995

[51] Int. Cl.[6] ..... B21B 1/46

[52] U.S. Cl. ..... 29/527.7; 29/33 C; 29/527.5; 72/349; 164/481

[58] Field of Search ..... 29/527.7, 527.5, 29/33 C; 164/481; 72/349

[56] References Cited

U.S. PATENT DOCUMENTS

| | | | |
|---|---|---|---|
| 3,402,591 | 9/1968 | Maeder . | |
| 3,685,337 | 8/1972 | Avitzur . | |
| 3,765,206 | 10/1973 | Shah . | |
| 3,942,351 | 3/1976 | Avitzur . | |
| 4,223,544 | 9/1980 | Main | 72/349 X |
| 4,235,646 | 11/1980 | Neufeld et al. | 29/527.7 X |
| 4,238,248 | 12/1980 | Gyöngyös et al. | 29/527.7 X |
| 4,282,044 | 8/1981 | Robertson et al. | 29/527.7 X |
| 4,562,720 | 1/1986 | Nishikawa | 72/349 |
| 4,934,443 | 6/1990 | Honeycutt . | |
| 5,106,429 | 4/1992 | McAuliffe et al. | 29/527.7 X |
| 5,356,495 | 10/1994 | Wyatt-Mair et al. | 29/527.7 X |
| 5,460,024 | 10/1995 | Meneghin . | |
| 5,515,908 | 5/1996 | Harrington | 164/481 |
| 5,564,491 | 10/1996 | Harrington | 164/481 |

FOREIGN PATENT DOCUMENTS

| | | | |
|---|---|---|---|
| 5677 | 7/1956 | Germany . | |
| 144873 | 11/1980 | Germany . | |
| 5-329560 | 12/1993 | Japan | 72/349 |
| 145197 | 1/1962 | U.S.S.R. . | |
| 602259 | 4/1978 | U.S.S.R. . | |
| 1521516 | 11/1989 | U.S.S.R. . | |

*Primary Examiner*—Carl J. Arbes

*Attorney, Agent, or Firm*—Philip L. McGarrigle; Keith V. Rockey

[57] ABSTRACT

A method for making hollow workpieces such as beverage containers with a circular die in which an aluminum alloy is strip cast whereby the alloy is solidified rapidly without substantial precipitation. Thereafter, the aluminum alloy is formed into a cup which is drawn and passed through one or more dies to iron the walls of the cup and thereby lengthen the side walls thereof using at least one circular die having a die angle of less than about 6°. It has been found that the use of such small die angles prevents or minimizes galling and tearoffs.

19 Claims, 6 Drawing Sheets

DIE ANGLE EFFECTS

TWIN BELT HEAT SINK CASTER

DIE ANGLE EFFECTS

Large Die Angle
1. Carry less lube
2. Small contact area

Small Die Angle
1. Carry more lube
2. Large contact area

METHOD FOR MAKING HOLLOW WORKPIECES

BACKGROUND OF THE INVENTION

The present invention relates to a method for the manufacture of hollow workpieces, and more particularly to the manufacture of hollow workpieces such as beverage containers from aluminum alloys.

PRIOR ART

It now conventional to manufacture hollow workpieces such as beverage containers from aluminum alloys. An aluminum alloy sheet stock is first blanked into a circular configuration and then cupped in accordance with well established techniques. The side walls are then redrawn and ironed by passing the cup through a series of dies, typically three or more, having diminishing bores. The dies thus produce an ironing effect which lengthens the side wall to produce a can body in which the side walls are thinner in dimension than its bottom.

One of the key characteristics of aluminum alloys used in the manufacture of such cans is the surface quality. To be commercially acceptable, the aluminum alloy sheet stock used in the manufacture of such cans must have a high surface quality free from scratches or other undesirable surface characteristics. For the most part, aluminum alloy sheet stocks used in the manufacture of beverage containers have been fabricated using well known ingot methods. The continuous casting of thin aluminum alloy strips is well known, but has, until recently, enjoyed little success primarily due to surface quality related problems. It has been generally recognized that continuous casting of metal strip has been limited to a relatively small number of alloys and products produced therefrom.

It has recently been discovered that strip casting of aluminum alloys to produce a strip cast alloy having surface qualities acceptable for use in can making can be achieved by carefully controlling the conditions under which aluminum alloys are strip cast. For example, in co-pending application, Ser. No. 173,663, filed Dec. 23, 1993, the disclosure of which is incorporated herewith by reference, there is described a dramatically improved process and apparatus for use in the strip casting of aluminum alloys in which aluminum alloys are deposited on a molding zone defined by a pair of continuous endless belts formed of a heat conductive material. As described in that copending application, each of the belts is mounted on a pulley whereby each of the belts defines curved surfaces about the pulley and thereafter a substantially flat surface. As described in the foregoing copending application, when the molten aluminum alloy is deposited on the curved surfaces of both belts, the molten alloy transfers heat to the metal belts. Distortion of the belts by reason of the deposition of a molten metal on an otherwise cool belt is substantially minimized because the belts are supported by the pulleys at the point at which the molten metal is deposited upon the belts. The heat thus transferred to the belts can then later be removed by cooling the belts when they are not in contact with either the molten metal or the hot cast metal strip.

Thus, the concept of casting on a curve coupled with cooling the belts at a point at which the belts are not in contact with either the molten metal or the cast metal strip avoids, or at least substantially minimizes, thermal distortion of the belts which would otherwise adversely affect the surface characteristics of the cast metal strip. For that reason, the invention as described in the foregoing copending application represents a dramatic improvement in the strip casting of aluminum alloys which enables aluminum alloys so cast to be used in the manufacture of aluminum alloy beverage containers. Even further improvements in the strip casting technique described in the foregoing application are illustrated in copending application, Ser. No. 173,369, filed Dec. 23, 1993, the disclosure of which is incorporated herewith by reference. In the invention disclosed in the latter application, use is made of means to control the spacing between the belts so that the nip defined by the plane passing through the axes of both pulleys exerts a compressive force on the metal being cast. In the invention described in that application, the molten metal is deposited on the curved surfaces of the belts and substantially solidifies thereon prior to the nip between the entry pulleys. In that system, the compressive force exerted on the frozen cast strip at this nip causes elongation thereof so that the cast strip is in compression in the direction of travel after it exits from the nip. It has been found that the longitudinal compression in conjunction with the compression exerted by the nip substantially minimizes cracking of the cast metal strip, thus dramatically improving the surface quality of the as-cast strip.

It has been discovered that the aluminum alloy strip cast according to the techniques described in the foregoing copending applications has unique characteristics. Without limitation as to theory, it is believed that the strip casting techniques described in the foregoing copending applications cause the aluminum alloy to freeze or solidify extremely rapidly to create a unique micro-structure. Not only is the micro-structure unique, so too are the metallic characteristics of the cast strip unique. By rapidly freezing or solidifying the aluminum alloy, there is insufficient time for precipitation of the alloying elements present in the aluminum alloy. As is well understood in the art, the precipitation of alloying elements present in the aluminum alloy as intermetallic compounds is a phenomenon related to both time and temperature. In the systems described in the foregoing copending applications, the aluminum alloys are frozen or solidified so rapidly that there is insufficient time for such alloying elements to precipitate as intermetallic compounds.

Thus, the strip casting of aluminum alloys using those techniques are characterized by substantially improved surface quality. It has been found, however, that aluminum alloys produced by such strip casting techniques have, when used in the manufacture of aluminum beverage containers, a tendency toward galling. Galling is a phenomenon which occurs during the ironing of a cup through series of dies in which aluminum from a preceding can adheres to the die. When the next cup is processed by the die, the aluminum alloy adhering to the die adversely affects the surface characteristics of the can walls.

It is accordingly an object of the invention to provide an improved method for the manufacture of hollow workpieces such as beverage containers from aluminum alloys which has been strip cast.

It is a more specific object of the invention to provide a method for making hollow workpieces such as beverage containers and the like in which the tendency of the aluminum alloy to cause galling is either eliminated or at least substantially reduced.

It is yet another object of the invention to provide a method for making hollow workpieces from strip cast aluminum alloys in which galling is reduced or substantially minimized by controlling the tooling geometry used in can making.

These and other objects and advantages of the invention appear more fully hereinafter from a detailed description of the invention.

SUMMARY OF THE INVENTION

The concept of the present invention resides in the discovery that aluminum alloys which have been strip cast can be formed into cups and ironed through one or more (and preferably two) dies to thereby lengthen the side walls of the cup by controlling the tooling geometry of at least one of the ironing dies to ensure that is has a die angle of less than 6°. It has been common practice, in the commercial manufacture of cans and like hollow workpieces, to employ three standard 8° ironing dies. It has been found that by controlling the number of ironing dies and the die angle of the ironing die, strip cast aluminum alloy can body stock which has been rapidly solidified without substantial precipitation of alloying elements can be ironed through the use of one or more dies to form a hollow workpiece in which galling has been either eliminated or substantially reduced. In addition, the use of a die geometry in which the die angle is less than 6° also serves to control the ironing force distribution to reduce tearoffs, the tendency of the wall of the can to tear away from the can.

Without limiting the present invention as to theory, it is believed that, with the reduced die geometry in accordance with the practice of the present invention, a greater percentage of the load created during the ironing operation is carried by the inside friction between the punch and the can, and less by the can wall tension. That serves to reduce both the galling effects as well as tearoffs of the can walls.

In the preferred practice of the invention, use is made of an ironing die having a die angle of less than 6°, and preferably less than 5°. The use of this particular geometry has been found to be particularly effective to reduce galling and tearoffs in strip cast aluminum alloys.

DETAILED DESCRIPTION OF THE INVENTION

Figure 1:
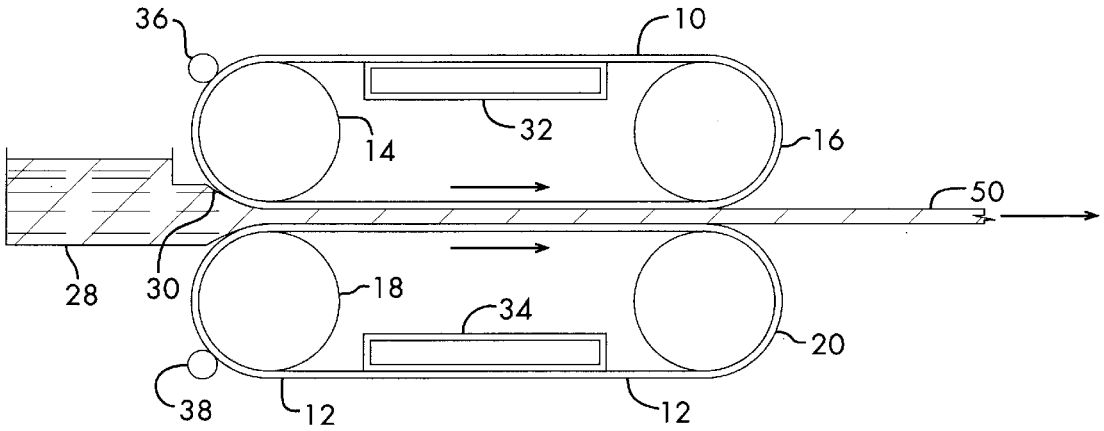
FIG. 1 is a schematic illustration of one form of the casting apparatus which can be used in the practice of the present invention.
Figure 2:
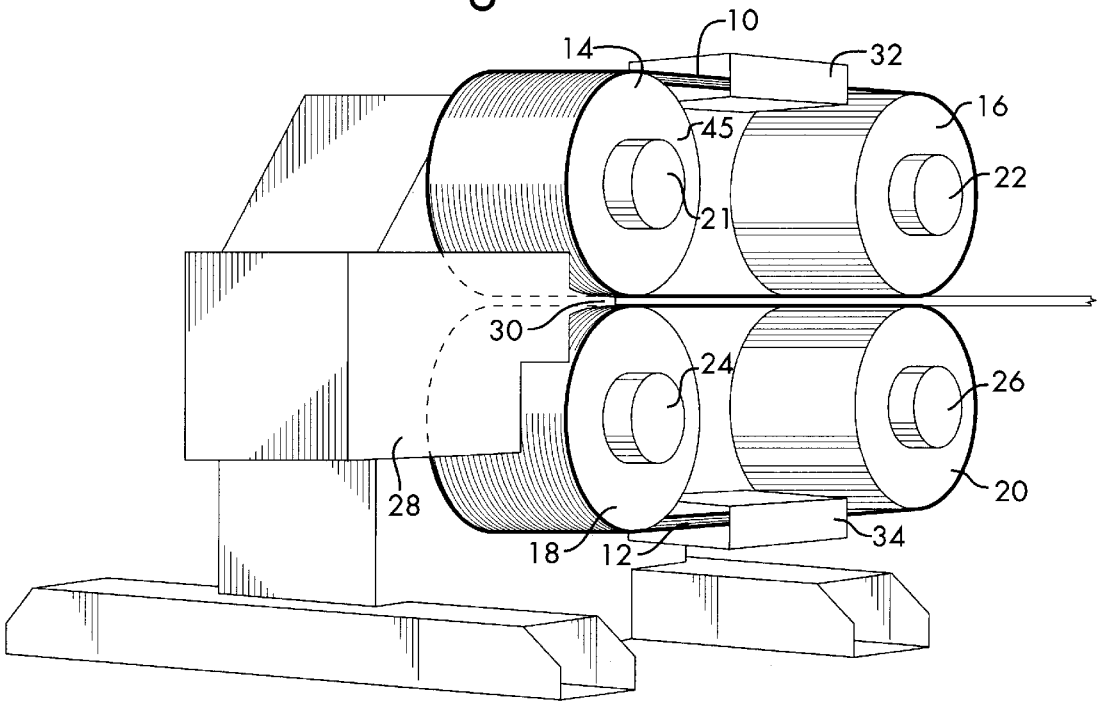
FIG. 2 is a perspective view of the casting apparatus shown in FIG. 1.
Figure 3:
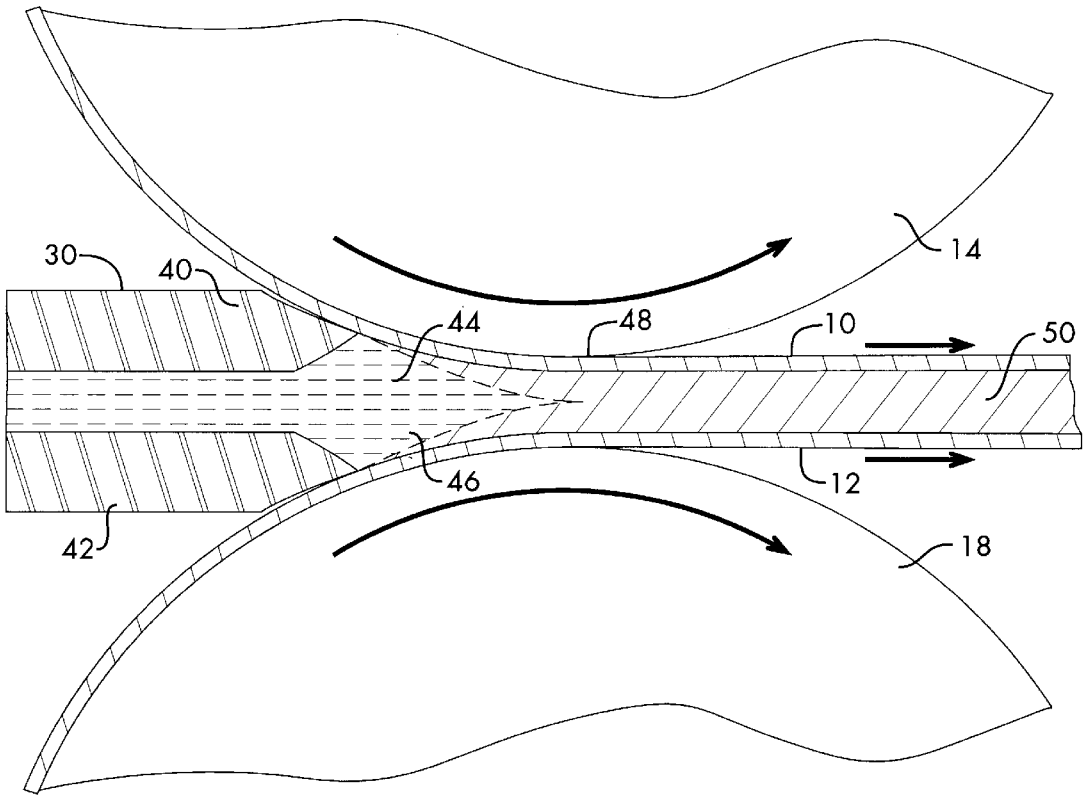
FIG. 3 is a cross-sectional view of the entry of molten metal to the apparatus illustrated in FIGS. 1 and 2.

The strip casting apparatus employed in the practice of the present invention is perhaps best illustrated in FIGS. 1, 2 and 3 of the drawings. As there shown, the apparatus includes a pair of endless belts 10 and 12 carried by a pair of upper pulleys 14 and 16 and a pair of corresponding lower pulleys 18 and 20 of FIG. 1. Each pulley is mounted for rotation about an axis 21, 22, 24, and 26 respectively of FIG. 2. The pulleys are of a suitable heat resistant type, and either or both of the upper pulleys 14 and 16 is driven by a suitable motor means not illustrated in the drawing for purposes of simplicity. The same is equally true for the lower pulleys 18 and 20. Each of the belts 10 and 12 is an endless belt, and is preferably formed of a metal which has low reactivity or is non-reactive with the metal being cast. Quite a number of suitable metal alloys may be employed as well known by those skilled in the art. Good results have been achieved using steel and copper alloy belts.

The pulleys are positioned, as illustrated in FIGS. 1 and 2, one above the other with a molding gap therebetween. In the preferred practice of the invention, the gap is dimensioned to correspond to the desired thickness of the metal strip being cast. Thus, the thickness of the metal strip being cast is thus determined by the dimensions of the nip between belts 10 and 12 passing over pulleys 14 and 18 along a line passing through the axis of pulleys 14 and 18 which is perpendicular to the belts 10 and 12.

Molten metal to be cast is supplied to the molding zone through suitable metal supply means 28 such as a tundish. The inside of tundish 28 corresponds in width to the width of the product to be cast, and can have a width up to the width of the narrower of the belts 10 and 12. The tundish 28 includes a metal supply delivery casting nozzle 30 to deliver a horizontal stream of molten metal to the molding zone between the belts 10 and 12. Such tundishes are conventional in strip casting.

Thus, the nozzle 30, as is best shown in FIG. 3 of the drawings, defines, along with the belts 10 and 12 immediately adjacent to nozzle 30, a molding zone into which the horizontal stream of molten metal flows. Thus, the stream of molten metal flowing substantially horizontally from the nozzle fills the molding zone between the curvature of each belt 10 and 12 to the nip of the pulleys 14 and 18. It begins to solidify and is substantially solidified by the point at which the cast strip reaches the nip of pulleys 14 and 18. Supplying the horizontally flowing stream of molten metal to the molding zone where it is in contact with a curved section of the belts 10 and 12 passing about pulleys 14 and 18 serves to limit distortion and thereby maintain better thermal contact between the molten metal and each of the belts as well as improving the quality of the top and bottom surfaces of the cast strip.

The casting apparatus of the invention includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal. In the most preferred embodiment as illustrated in FIGS. 1 and 2, the coolers 32 and 34 are positioned as shown on the return run of belts 10 and 12, respectively. In that embodiment, the cooling means 32 and 34 can be conventional cooling means such as fluid cooling nozzles positioned to spray a cooling fluid directly on the inside and/or outside of belts 10 and 12 to cool the belts through their thicknesses. In that preferred embodiment, it is sometimes desirable to employ scratch brush means 36 and 38 which frictionally engage the endless belts 10 and 12, respectively, as they pass over pulleys 14 and 18 to clean any metal or other forms of debris from the surface of the endless belts 10 and 12 before they receive molten metal from the tundish 28.

Thus, in the practice of this invention, molten metal flows horizontally from the tundish through the casting nozzle 30 into the casting or molding zone defined between the belts 10 and 12 where the belts 10 and 12 are heated by heat transfer from the cast strip to the belts 10 and 12. The cast metal strip remains between and conveyed by the casting belts 10 and 12 until each of them is turned past the centerline of pulleys 16 and 20. Thereafter, in the return loop, the cooling means 32 and 34 cool the belts 10 and 12, respectively, and remove therefrom substantially all of the heat transferred to the belts in the molding zone. After the belts are cleaned by the scratch brush means 36 and 38 while passing over pulleys 14 and 18, they approach each other to once again define a molding zone.

The most preferred supply of molten metal from the tundish through the casting nozzle 30 is shown in greater detail in FIG. 3 of the drawings. As is shown in that figure, the casting nozzle 30 is formed of an upper wall 40 and a lower wall 42 defining a central opening 44 therebetween whose width may extend substantially over the width of the belts 10 and 12 as they pass around pulleys 14 and 18, respectively.

The distal ends of the walls 40 and 42 of the casting nozzle 30 are in substantial proximity of the surface of the casting belts 10 and 12, respectively, and define with the belts 10 and 12 a casting cavity or molding zone 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12.

In the preferred practice of the invention, sufficient setback (defined as the distance between first contact 47 of the molten metal 46 and the nip 48 defined as the closet approach of the entry pulleys 14 and 18) should be provided to allow substantially complete solidification prior to the nip 48. In prior art belt casters, the molten metal contacts the belt after the nip 48 in the straight section. Hence, in the present invention solidification is substantially complete prior to the nip 48, and in prior art belt caster solidification does not begin until after the nip 48.

The importance of freezing before the nip 48 in the present invention is that the belts 10 and 12 are much more stable when held in tension on the curved surface of the pulley and distort much less than if the molten metal 46 first contacts the belts 10 and 12 in the straight section as in prior art. Moreover, in the practice of the present invention, there is a momentary high thermal gradient over the belts 10 and 12 when first contacted by molten metal 46. Because each belt is in tension and is well supported prior to the nip by the pulleys 14 and 18, the belts are more stable against distortion arising from that momentary thermal gradient. In addition, the space between the belts at the time that they first come into contact with the molten metal is substantially larger then the gap between the belts corresponding to the thickness of the cast strip. As a result, any distortion in the belts have little effect on the metal being cast at that location. The high thermal gradient largely dissipates before the belts 10 and 12 reach the nip 48, and thus any distortions that do occur diminish as the belts approach the nip.

The thickness of the strip that can be cast is, as those skilled in the art will appreciate, related to the thickness of the belts 10 and 12, the return temperature of the casting belts and the exit temperature of the strip and belts. In addition, the thickness of the strip depends also on the metal being cast. It has been found that aluminum strip having a thickness of 0.100 inches using steel belts having a thickness of 0.08 inches provides a return temperature of 300° F. and an exit temperature of 800° F.

For some applications, it can be desirable to employ one or more belts having longitudinal grooves on the surface of the belt in contact with the metal being cast. Such grooves have been used in single drum casters as described in U.S. Pat. No. 4,934,443.

Figure 4:
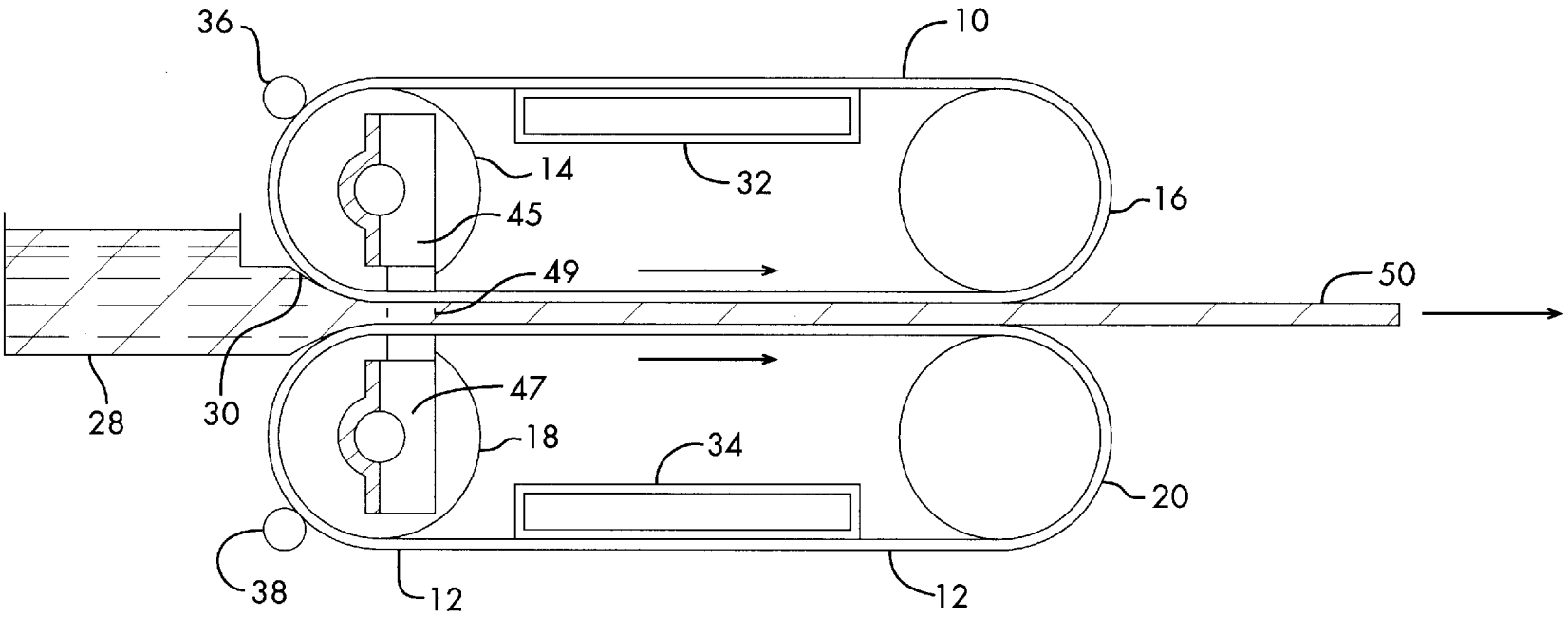
FIG. 4 is a schematic illustration of another casting apparatus which may be used in the practice of the present invention.
Figure 5:
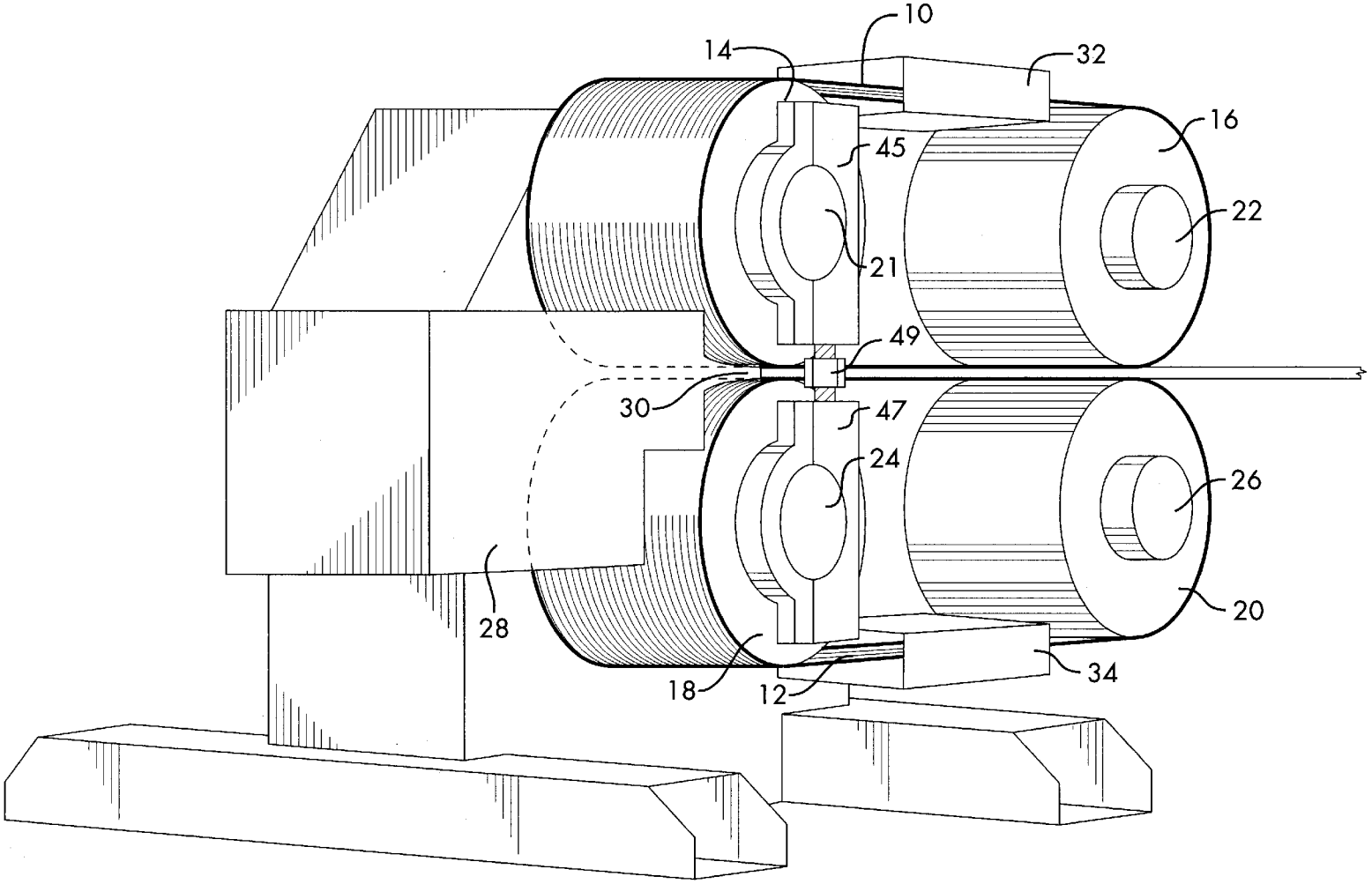
FIG. 5 is a perspective view of the apparatus of FIG. 4.
Figure 6:
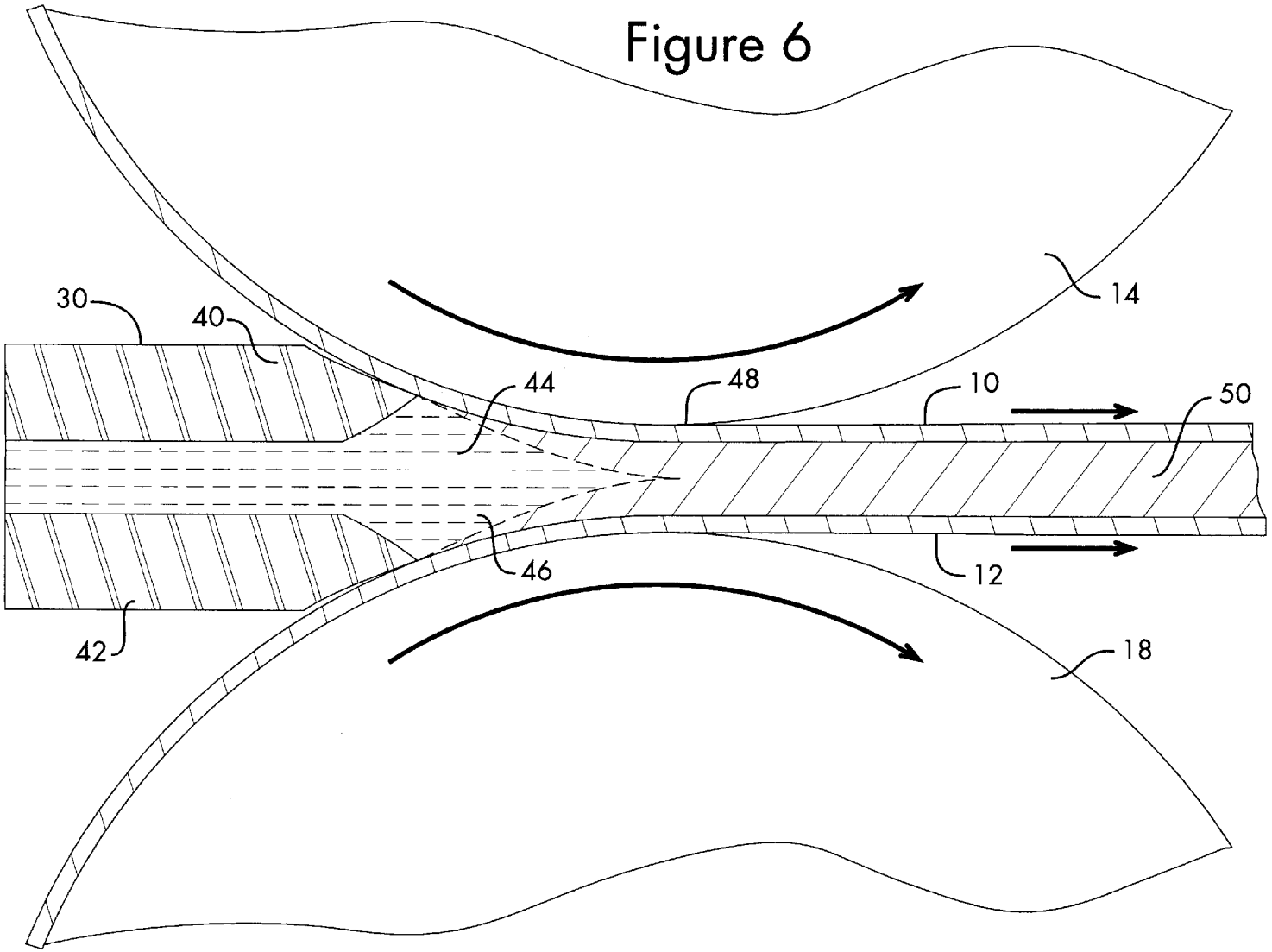
FIG. 6 is a cross-sectional view of the entry of molten metal to the apparatus illustrated in FIGS. 4 and 5.

A highly preferred form of the strip casting apparatus is shown in FIGS. 4 and 6, as described in copending application, Ser. No. 173,369. As there shown, the apparatus includes a pair of endless belts 10 and 12 carried by a pair of upper pulleys 14 and 16 and a pair of corresponding lower pulleys 18 and 20 of FIG. 4. Each pulley is mounted for rotation about an axis 21, 22, 24, and 26 respectively of FIG. 5. One or both of the pulleys 14 and/or 16 is driven by a suitable motor means not illustrated in the drawing for purposes of simplicity. The same is equally true for the lower pulleys 18 and 20. Each of the belts 10 and 12 is an endless belt.

The pulleys are positioned, as illustrated in FIGS. 4 and 5, one above the other with a molding zone therebetween. In the preferred practice of the invention, the gap is dimensioned to correspond to the desired thickness of the metal strip being cast. Thus, the thickness of the metal strip being cast is thus determined by the dimensions of the nip between belts 10 and 12 passing over pulleys 14 and 18 along a line passing through the axis of pulleys 14 and 18 which is perpendicular to the belts 10 and 12.

In accordance with the preferred practice, there is provided means associated with the entry pulleys 14 and 18 to prevent displacement of those pulleys relative to each other. Any suitable apparatus to rigidly fix the relative positions of pulleys 14 and 18 may be used. FIGS. 4 and 5 illustrate a simple mechanism including a pillow block 45 and 47 on each of the axes 21 and 24 of the entry pulleys 14 and 18, respectively, secured to each other by means of a tension member 49. The tension member may be either fixed or adjustable; it has been found that good results are obtained by simply using a turnbuckle 49 as the tension member to prevent relative displacement of axes 21 and 24 relative to each other. As will be appreciated by those skilled in the art, various other and more sophisticated tension members may likewise be used. For example, use can be made of a hydraulic cylinder as the tension member to prevent relative displacement of the axes 21 and 24 relative to each other. The use of such a hydraulic cylinder has the further advantage that it is adjustable, and thus the tension can be conveniently changed depending on the application and the metal being cast.

Molten metal to be cast is supplied to the molding zone through suitable metal supply means 28 such as a tundish. The inside of tundish 28 corresponds in width to the width of the product to be cast, and can have a width up to the width of the narrower of the belts 10 and 12. The tundish 28 includes a metal supply delivery casting nozzle 30 to deliver a horizontal stream of molten metal to the molding zone between the belts 10 and 12. Such tundishes are conventional in strip casting.

Thus, the nozzle 30, as is best shown in FIG. 6 of the drawings, defines, along with the belts 10 and 12 immediately adjacent to nozzle 30, a molding zone into which the horizontal stream of molten metal flows. Thus, the stream of molten metal flowing substantially horizontally from the nozzle fills the molding zone between the curvature of each belt 10 and 12 to the nip of the pulleys 14 and 18. It begins to solidify and is substantially solidified prior to the point at which the cast strip reaches the nip of pulleys 14 and 18. Supplying the horizontally flowing stream of molten metal to the molding zone where it is in contact with a curved section of the belts 10 and 12 passing about pulleys 14 and 18 serves to limit distortion and thereby maintain better thermal contact between the molten metal and each of the belts as well as improving the quality of the top and bottom surfaces of the cast strip.

In accordance with the preferred embodiment, the casting apparatus of the invention includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal. In the most preferred embodiment as illustrated in FIGS. 1 and 2, the coolers 32 and 34 are positioned as shown on the return run of belts 10 and 12, respectively. In that embodiment, the cooling means 32 and 34 can be conventional cooling means such as fluid cooling nozzles positioned to spray a cooling fluid directly on the inside and/or outside of belts 10 and 12 to cool the belts through their thicknesses. In that preferred embodiment, it is sometimes desirable to employ scratch brush means 36 and 38 which frictionally engage the endless belts 10 and 12, respectively, as they pass over pulleys 14 and 18 to clean any metal or other forms of debris from the surface of the endless belts 10 and 12 before they receive molten metal from the tundish 28.

Thus, in the practice of this invention, molten metal flows horizontally from the tundish through the casting nozzle 30 into the casting or molding zone defined between the belts 10 and 12 where the belts 10 and 12 are heated by heat transfer from the cast strip to the belts 10 and 12. The cast metal strip remains between and conveyed by the casting belts 10 and 12 until each of them is turned past the centerline of pulleys 16 and 20. Thereafter, in the return loop, the cooling means 32 and 34 cool the belts 10 and 12, respectively, and remove therefrom substantially all of the heat transferred to the belts in the molding zone. After the belts are cleaned by the scratch brush means 36 and 38 while passing over pulleys 14 and 18, they approach each other to once again define a molding zone.

The distal ends of the walls 40 and 42 of the casting nozzle 30 are in substantial proximity of the surface of the casting belts 10 and 12, respectively, and define with the belts 10 and 12 a casting cavity or molding zone 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12.

In the preferred practice of the invention, sufficient setback (defined as the distance between first contact 47 of the molten metal 46 and the nip 48 defined as the closet approach of the entry pulleys 14 and 18) should be provided to allow substantially complete solidification prior to the nip 48. In prior art belt caster, the molten metal contacts the belt after the nip 48 in the straight section. Hence, in the present invention solidification is substantially complete prior to the nip 48.

The importance of freezing before the nip 48 in the present invention is that the belts 10 and 12 are much more stable when held in tension on the curved surface of the pulley and distort much less than if the molten metal 46 first contacts the belts 10 and 12 in the straight section as in prior art. Moreover, in the practice of the present invention, there is a momentary high thermal gradient over the belts 10 and 12 when first contacted by molten metal 46. Because each belt is in tension and is well supported prior to the nip by the pulleys 14 and 18, the belts are more stable against distortion arising from that momentary thermal gradient. In addition, the space between the belts at the time that they first come into contact with the molten metal is substantially larger then the gap between the belts corresponding to the thickness of the cast strip. As a result, any distortion in the belts have little effect on the metal being cast at that location. The high thermal gradient largely dissipates before the belts 10 and 12 reach the nip 48, and thus any distortions that do occur diminish as the belts approach the nip.

The importance of freezing or solidification before the nip 48 also arises from the fact that as shown in FIG. 3 of the drawings, the metal solidifying between the curved surfaces in the molding zone prior to the nip has a dimension or thickness greater than the corresponding dimension or thickness of the nip itself. That insures that when the solidified cast metal is advanced to the nip 48, it has a larger dimension than that of the nip, thereby insuring that the nip 48 exerts a compressive force on the cast metal strip and thereby cause elongation to improve not only surface characteristics but also to reduce the tendency of the strip to crack. In addition, the compressive force exerted on the cast metal strip after solidification between the point of solidification and the nip itself insures good thermal contact between the cast metal strip and the belts.

The amount of compressive force is not critical to the practice of the invention. It has been found that the compressive force should be sufficiently high as to insure good thermal contact between the cast metal strip and the belt as well as sufficiently high so as to cause elongation. The elongation is preferably sufficient to insure that the cast metal strip, while it is conveyed from the nip 48 through the remainder of the molding zone, is in a state of longitudinal compression as distinguished from tension. As is described herein above, it has been found that maintaining the cast strip under compressive force serves to minimize cracking that would otherwise occur if the cast strip were maintained under tension. In general, it is desirable that the percent elongation be relatively low, generally below 15 percent, and most preferably below 10 percent. Good results have been achieved by the practice of the invention when the percent elongation is less than 5 percent.

The aluminum alloy strip, once it has been cast, is then subjected to conventional rolling operations, either by hot rolling, cold rolling or combinations thereof to form an aluminum alloy sheet stock. Such rolling operations are themselves conventional are part of the present invention. After the can stock has been formed, either with or without an intermediate annealing step, it is then blanked into a circular configuration and cupped in accordance with well-known techniques.

After cupping, the aluminum alloy cup is then drawn to lengthen the side walls of the cup and ironed in accordance with conventional procedures. For a complete review of such ironing procedures, reference can be made to U.S. Pat. No. 3,942,351 which discloses the use of ironing dies employed with either a mandrel or punch and the ironing die.

Figure 7:
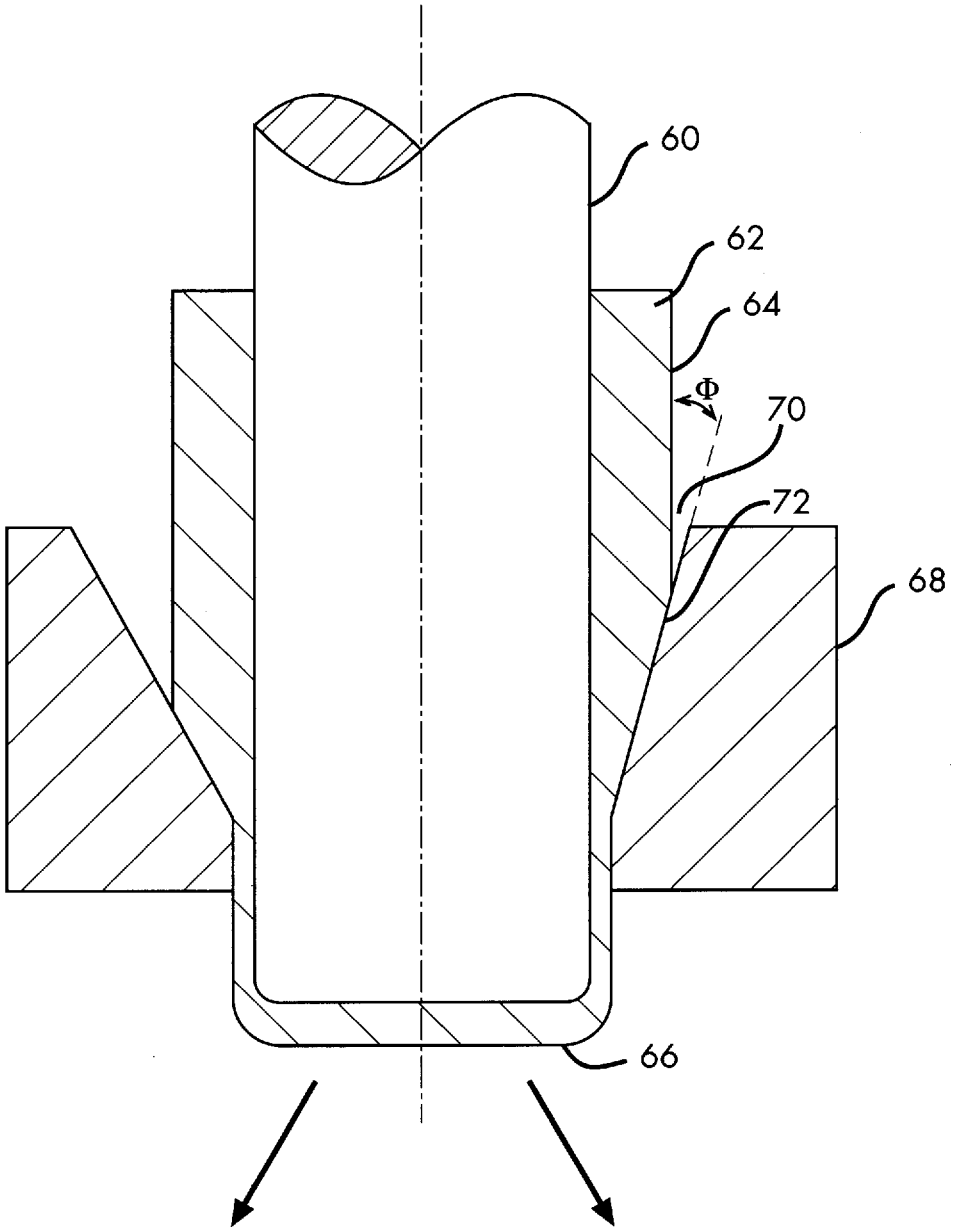
FIG. 7 is cross-sectional view of the ironing die employed in the practice of the present invention.

A typical ironing die employed in the practice of the present invention is shown in FIG. 7. As there shown, the punch 60 is inserted into the cup 62 having side walls 64 and a bottom 66. The die 68 is an annular die having a central opening 70 and a sloped surface 72 which defines the die angle with respect to the vertical. In FIG. 7, the die angle is denoted by $\phi$.

In the ironing of the cup, the punch 60 which fills the interior of the hollow workpiece or cup 62 is advanced downwardly, causing the walls 64 of the cup to fractionally engage the sloped surface 72 of the die, thereby causing the side walls 64 of the cup to be ironed and elongated to form a can body in which the side walls are thinner in dimension than the bottom.

In accordance with the concepts of the present invention, it is the angle $\phi$ which is controlled in the die geometry to ensure that the angle is less than 6°, and preferably less than 5°. Such small die angles have been found to minimize galling because the small angle $\phi$ with the sloped surface 72 ensures greater lubrication during the ironing operation. In that regard, it is conventional in such ironing operations to employ lubricants, generally an emulsion of oil in water. Because the small die angle affords a greater contact area between the walls of the cup and the sloped or angled surface of the die, there is provided greater lubrication between the cup walls and the surface of the die. It has been found that the use of such small die angles not only provides greater lubrication, but also assures substantially reduced galling and lower tearoff rates. Generally, a large die angle has a smaller contact area and provides less lubrication and a small die angle has a larger contact area and carries more lubrication.

In the practice of the invention, the ironing of the walls of the cup can be carried out in more than one operation. In general, use can be made of progressively smaller dies so that the ironing operation can be carried out in two to four separate ironing steps, and preferably two ironing steps. It has been found that at least one of the ironing operations should be carried out using a die having a die angle of less than 6°. Any other ironing operations can be carried out using larger die angles up to 8° or higher. In the most preferred embodiment of the invention, however, each of the ironing operations is carried out using a die having a die angle of less than 6°.

To illustrate the advantages of the use of a reduced die angle, a strip cast aluminum alloy 3104 is subjected to two ironing operations using, in the first ironing operation, die angles ranging from 40° to 12°. In each of the cups, a constant and standard 8° die was used in the second ironing operation. The tearoff rate can be illustrated by the following:

| 1 Ring Die Angle | Last Ring Reduction (%) | Tearoffs/ Total Cans | Tearoff Rate per 1,000 Can |
|---|---|---|---|
| 8° | 47.2 | 5/1630 | 3.1 |
| 4° | 47.2 | 2.1420 | 1.4 |
| 8° | 46.2 | 5/1350 | 3.7 |
| 12° | 45.9 | 4/1500 | 2.7 |
| 8° | 47.2 | 15/4500 | 3.3 |
| 4° | 47.2 | 10/4700 | 2.1 |

As can be seen from the foregoing table, the tearoff rate can be reduced using the die geometry called for by the present invention. In addition, galling is substantially reduced as well.

It will be understood that various changes and modifications can be made in the details of procedure and use without departing from the operation of the invention, especially as defined in the following claims.

What is claimed is:

1. A method for making hollow workpieces with a circular die comprising:

(a) strip casting aluminum alloy to rapidly solidify the alloy without substantial precipitation of alloying elements and forming a cast strip;

(b) forming the strip into a cup for the manufacture of a hollow workpiece; and (c) passing the cup through one or more dies to iron the walls of the cup and thereby lengthen the side wall of the cup to form a hollow workpiece, at least one of the dies having a die angle of less than about 6°.

2. A method as defined in claim 1 wherein the die angle is less than about 5°.

3. A method as defined in claim 1 wherein the aluminum alloy is strip cast by depositing molten aluminum alloy in a molding zone defined between a pair of endless belts.

4. A method as defined in claim 3 wherein each of the endless belts is mounted on an entry pulley whereby the belts define curved surfaces about the entry pulley and the molten metal is deposited on the curved surfaces.

5. A method as defined in claim 4 wherein each of the belts is cooled to remove heat transferred thereto by the molten metal or the cast strip while the belts are not in contact with either the molten metal or the hot cast strip.

6. A method as defined in claim 1 wherein the molten metal is solidified prior to the nip defined by the endless belt.

7. A method as defined in claim 1 wherein the cast metal strip is subjected to a compressive force at the nip sufficient to effect elongation thereof whereby the cast metal strip, after it passes from the nip, is in a state of compression longitudinally along the length of the strip.

8. A method as defined in claim 1 wherein the ironing of the cup is carried out in the presence of a lubricant.

9. A method as defined in claim 1 which includes the step of rolling the cast metal strip before forming the strip into a cup.

10. A method as defined in claim 1 wherein the cup is passed through two ironing dies.

11. A method as defined in claim 10 wherein each of the two ironing dies has a die angle of less than about 6°.

12. A method for making hollow workpieces with a circular die comprising:

(a) strip casting aluminum alloy to rapidly solidify the alloy without substantial precipitation of alloying elements and forming a cast strip;

(b) forming the strip into a cup for the manufacture of a hollow workpiece; and (c) passing the cup through only two dies to iron the walls of the cup and thereby lengthen the side wall of the cup to form a hollow workpiece.

13. A method in accordance with claim 12 wherein at least one of the dies has a die angle of less than 6°.

14. A method in accordance with claim 12 wherein both dies have a die angle of less than 6°.

15. A method for making hollow workpieces with a circular die comprising:

(a) forming an aluminum strip;

(b) forming the strip into a cup which has a bottom and side walls; and (c) passing the cup through one or more dies to iron and lengthen the side walls of the cup to form a hollow workpiece, at least one of the dies has a die angle of less than 6°.

16. A method in accordance with claim 15 wherein there are no more than two dies.

17. A method in accordance with claim 16 wherein both dies have a die angle of less than 6°.

18. A method in accordance with claim 15 wherein there are more than two dies and at least two have die angles of less than 6°.

19. A method in accordance with claim 15 wherein there are no more than two dies and both have die angles of less than 5°.

* * * * *